US005887528A

United States Patent [19]

Lummis

[11] Patent Number: 5,887,528

[45] Date of Patent: Mar. 30, 1999

[54] PHONE STAND SYSTEM

[76] Inventor: Robert C. Lummis, 315 Pioxi St., Copiague, N.Y. 11726

[21] Appl. No.: 3,569

[22] Filed: Jan. 6, 1998

[51] Int. Cl.[6] ..... A47B 85/00

[52] U.S. Cl. ..... 108/26; 312/233; 312/223.4; 108/32; 108/50.02

[58] Field of Search ..... 108/25, 26, 50.02, 108/50.01, 32; 312/140.4, 233, 280, 223.4; 211/42, 26; 248/441.1, 225.11, 223.41; 379/446, 454

[56] References Cited

U.S. PATENT DOCUMENTS

D. 340,723 10/1993 Halligan .
783,973 2/1905 McAnelly ..... 108/26 X
1,238,899 9/1917 Enell ..... 312/233 X
2,481,271 9/1949 Willey .
2,612,721 10/1952 Pollard ..... 248/441.1
3,262,667 7/1966 Perez-Seoane ..... 312/233 X
5,105,460 4/1992 Williams .
5,187,744 2/1993 Richter .
5,471,530 11/1995 Chen .
5,606,608 2/1997 Krutke .

*Primary Examiner*—Peter M. Cuomo
*Assistant Examiner*—Janet M. Wilkens
*Attorney, Agent, or Firm*—Joseph N. Breaux

[57] ABSTRACT

A phone stand system that includes a stand assembly and a phone tray assembly. In a preferred embodiment, the stand system also includes a wall mount assembly that is securable to a vertical surface for supporting the phone tray assembly in place of the stand assembly.

17 Claims, 3 Drawing Sheets

PHONE STAND SYSTEM

TECHNICAL FIELD

The present invention relates to tables, stands and the like and more particularly to a phone stand system including a stand assembly and a phone tray assembly; the stand assembly including two vertical support legs, a rear stand and tray support including a tray connecting rail extending from an upper side end thereof, a stand top with a phone book tray indentation and two drink holders formed therein, a height adjustable tray, and a base support; the two vertical support legs and the rear stand and tray support supporting the stand top and the base support; the height adjustable tray being detachably connectable to the two vertical support legs and the rear stand and tray support; the phone tray assembly including a phone book tray sized to engage the phone book tray indentation of the stand top, an L-shaped support bracket extending from the side edge of the phone book tray, an angled phone tray connected across the L-shaped support bracket, and a tray connecting channel member secured to an exteriorly facing surface of the L-shaped support bracket; the tray connecting channel member having a receiving channel defined therein between two end openings and a side slot sized to engagingly receiving the tray connecting rail of the rear stand and tray support.

BACKGROUND ART

Many telephone users would like a stand for supporting a cordless phone at a convenient location out of doors. It would be a benefit to these individuals to have a phone stand system that could be manufactured out of durable plastic or wood that could be used to support a cordless phone in a desired location. Because it may be desirable to move the phone stand to other location it could also be desirable to have a phone stand system that included a stand assembly as well as a wall mount assembly.

GENERAL SUMMARY DISCUSSION OF INVENTION

It is thus an object of the invention to provide a phone stand system for supporting a cordless phone in a desired location.

It is further object of the invention to provide a phone stand system that includes a wall mount assembly.

It is a still further object of the invention to provide a phone stand system that includes a stand assembly and phone tray assembly; the stand assembly including a tray connecting rail extending from an upper side end thereof, a stand top with a phone book tray indentation and two drink holders formed therein, a height adjustable tray, and a base support; the two vertical support legs and the rear stand and tray support supporting the stand top and the base support; the height adjustable tray being detachably connectable to the two vertical support legs and the rear stand and tray support; the phone tray assembly including a phone book tray sized to engage the phone book tray indentation of the stand top, an L-shaped support bracket extending from the side edge of the phone book tray, an angled phone tray connected across the L-shaped support bracket, and a tray connecting channel member secured to an exteriorly facing surface of the L-shaped support bracket; the tray connecting channel member having a receiving channel defined therein between two end openings and a side slot sized to engagingly receiving the tray connecting rail of the rear stand and tray support.

It is a still further object of the invention to provide a phone stand system that accomplishes some or all of the above objects in combination.

Accordingly, a phone stand system is provided. The phone stand system includes a stand assembly and phone tray assembly; the stand assembly including two vertical support legs, a rear stand and tray support including a tray connecting rail extending from an upper side end thereof, a stand top with a phone book tray indentation and two drink holders formed therein, a height adjustable tray, and a base support; the two vertical support legs and the rear stand and tray support supporting the stand top and the base support; the height adjustable tray being detachably connectable to the two vertical support legs and the rear stand and tray support; the phone tray assembly including a phone book tray sized to engage the phone book tray indentation of the stand top, an L-shaped support bracket extending from the side edge of the phone book tray, an angled phone tray connected across the L-shaped support bracket, and a tray connecting channel member secured to an exteriorly facing surface of the L-shaped support bracket; the tray connecting channel member having a receiving channel defined therein between two end openings and a side slot sized to engagingly receiving the tray connecting rail of the rear stand and tray support. In a preferred embodiment the phone stand system also includes a wall mount assembly that is securable to a vertical surface and that includes a closed bottomed attachment rail sized to engage the tray connecting channel member of the phone tray assembly. A rail mount assembly is also preferably included that includes a horizontal surface mount plate that is securable to a horizontal surface and that includes a closed bottomed attachment rail sized to engage the tray connecting channel member of the phone tray assembly.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
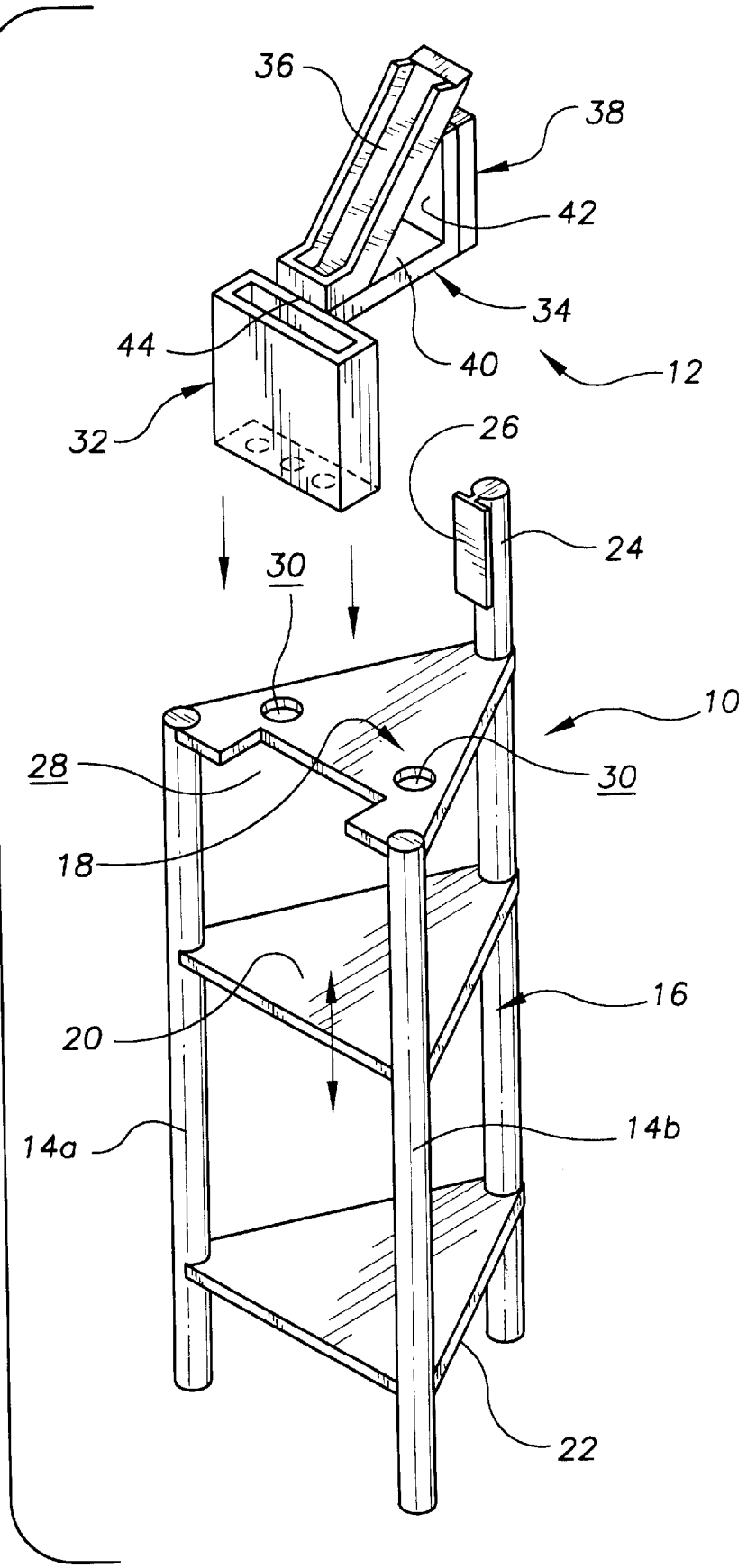
FIG. 1 is an exploded perspective view of an exemplary embodiment of the phone stand system showing the stand assembly including the two vertical support legs, the rear stand and tray support including the tray connecting rail, the stand top with the phone book tray indentation and the two drink holders, the height adjustable tray, and the base support; and the phone tray assembly including the phone book tray, the L-shaped support bracket, the angled phone tray, and the tray connecting channel member.

FIG. 1 is an exploded perspective view showing an exemplary stand assembly, generally designated 10, and an exemplary phone tray assembly, generally designated 12, of an exemplary phone stand system of the present invention. Although other materials such as wood and metal are suitable for constructing the phone stand system of the present invention, in this embodiment, stand assembly 10 and phone tray assembly 12 are of plastic construction.

Stand assembly 10 includes two vertical support legs 14*a,* 14 *b;* a rear stand and tray support, generally designated 16; a stand top, generally designated 18; a friction fit, height adjustable tray 20; and a base support 22. Rear stand and tray support 16 has an upper side end 24 having a tray connecting rail 26 extending outwardly therefrom. In this embodiment, tray connecting rail 26 has a T-shaped cross section. Stand top 18 has a rectangular shaped phone book tray indentation 28 and two cylinder shaped drink holders 30. Phone book tray indentation 28 is positioned between the two vertical support legs 14*a,* 14*b,* and opposite rear stand and tray support 16.

Figure 2:
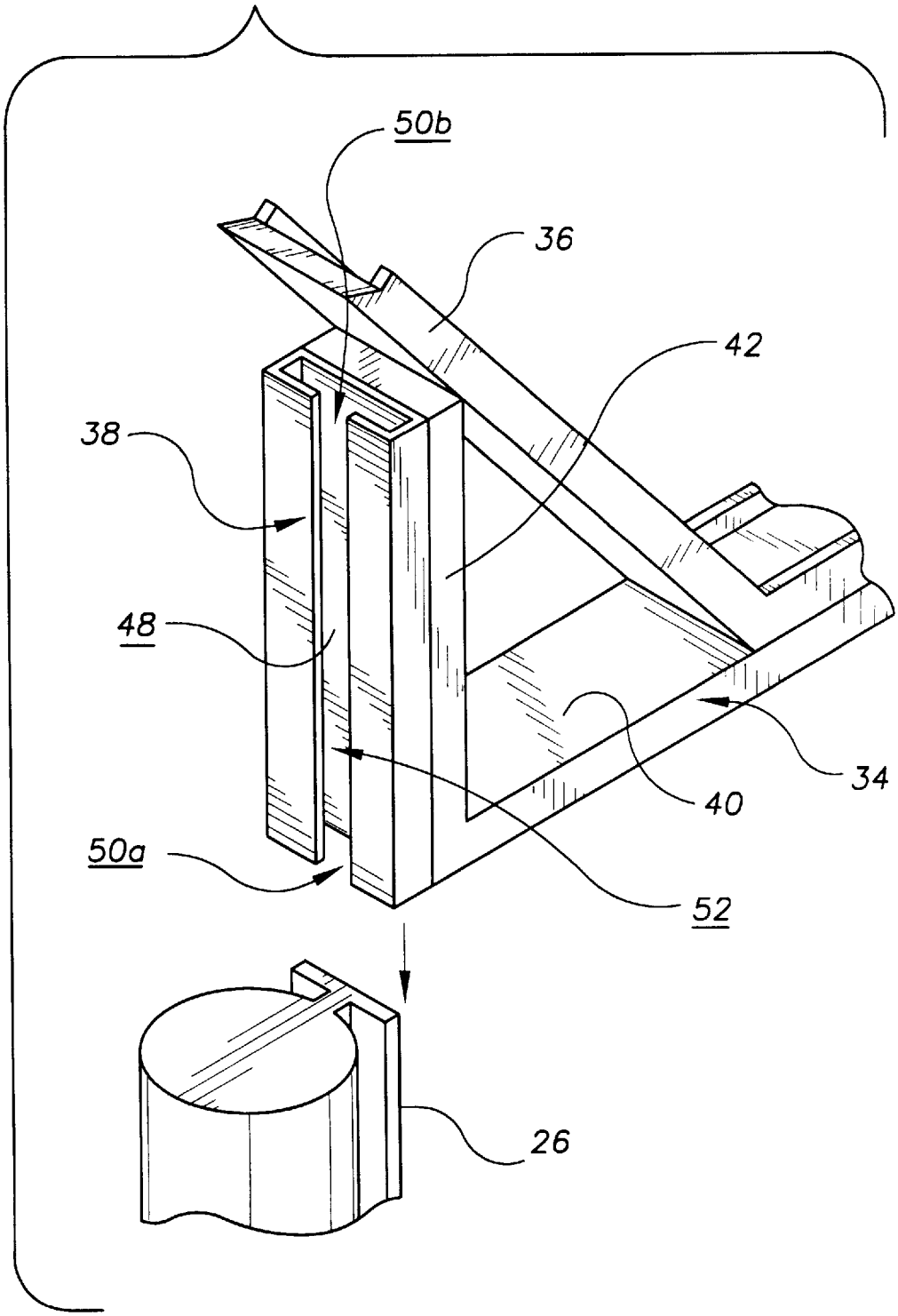
FIG. 2 is a detail perspective view showing the tray connecting rail of the rear stand and tray support of the stand assembly and the L-shaped support bracket, the angled phone tray, and the tray connecting channel member of the phone tray assembly.

Phone tray assembly 12 includes an open topped, rectangular box shaped, phone book tray, generally designated 32; an L-shaped support bracket, generally designated 34; an angled phone tray member 36; and a tray connecting channel member, generally designated 38 (more clearly shown in FIG. 2). L-shaped support bracket 34 includes a longer leg 40 and a shorter leg 42 that is oriented a right angle with respect to longer leg 40. Longer leg 40 extends from a center of a side edge 44 of phone book tray 32.

With reference now to FIG. 2, angled phone tray member 36 is connected across longer leg 40 and shorter leg 42. Tray connecting channel member 38 is secured to an exteriorly facing surface of the shorter leg 42 of L-shaped support bracket 34. Tray connecting channel member 38 has a receiving channel 48 defined therein between two end opening 50*a,* 50*b* and a side slot 52 that is sized to engagingly receiving tray connecting rail 26.

Figure 3:
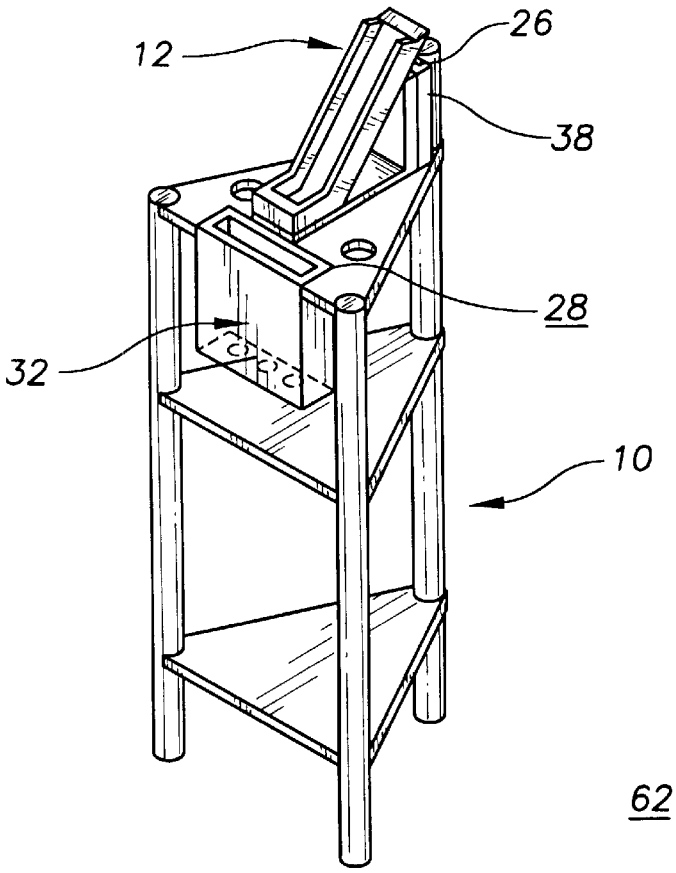
FIG. 3 is a perspective view showing the phone tray assembly seated onto the stand assembly with the tray connecting rail positioned into the tray connecting channel member and the phone book tray positioned into the phone book tray indentation of the stand top.

With reference to FIG. 3, in use phone tray assembly 12 is seated onto stand assembly 10 by simultaneously positioning phone book tray 32 into phone book tray indentation 28 and positioning tray connecting channel member 38 (FIG. 2) over tray connecting rail 26 (FIG. 2).

Figure 4:
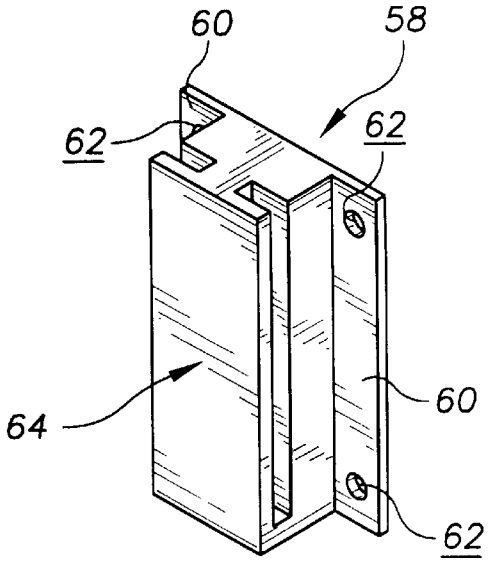
FIG. 4 is a perspective view of an optional wall mount assembly including a wall mount plate having four mounting apertures and a closed bottomed attachment rail sized to engage the tray connecting channel member of the phone tray assembly.

With reference to FIG. 4, the exemplary phone stand system also includes a wall mount assembly, generally designated 58, that is used when it is desired to attached phone tray assembly 12 (FIG. 1) to a wall or other vertically oriented surface. Wall mount assembly 58 is of plastic construction and includes two mounting plates 60 each having two mounting apertures 62; and a closed bottomed attachment rail, generally designated 64, that is sized to engage tray connecting rail member 26 (FIG. 2) in the same fashion as tray connecting channel member 38 (FIG. 2) with the exception that closed bottomed attachment rail 64 is provided with two stops 66 (only one shown) to prevent tray connecting channel member 38 (FIG. 2) from sliding entirely over closed bottomed attachment rail 64.

Figure 5:
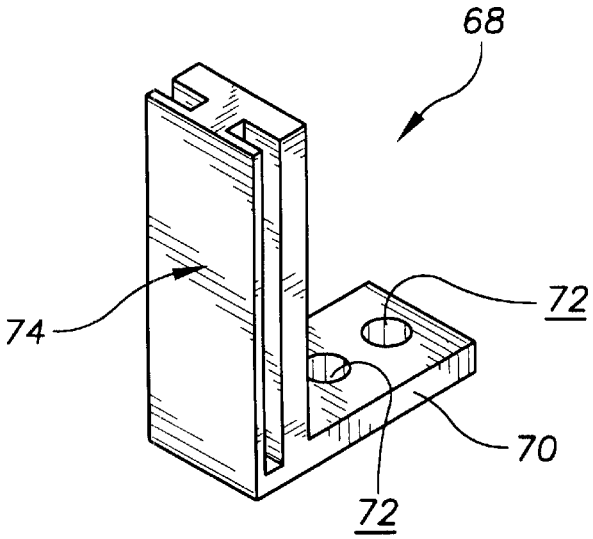
FIG. 5 is a perspective view of an optional rail mount assembly including a horizontal surface mount plate that is securable to a horizontal surface and a closed bottomed attachment rail sized to engage the tray connecting channel member of the phone tray assembly.

With reference to FIG. 5, the exemplary phone stand system also includes a rail mount assembly, generally designated 68, that is used when it is desired to attached phone tray assembly 12 (FIG. 1) to a the horizontal surface such as the railing of a deck or other horizontally oriented surface. Rail mount assembly 68 is of plastic construction and includes a horizontal surface mount plate 70 having two mounting apertures 72 for screw mounting rail mount assembly 68. Rail mount assembly 68 also includes a closed bottomed attachment rail 74 that is oriented at a right angle with respect to horizontal surface mount plate 70 but otherwise is identical in construction and function to closed bottomed attachment rail 64 of wall mount assembly 58 (FIG. 4).

It can be seen from the preceding description that a phone stand system has been provided that includes a wall mount assembly and that includes a stand assembly and a phone tray assembly; the stand assembly including two vertical support legs, a rear stand and tray support including a tray connecting rail extending from an upper side end thereof, a stand top with a phone book tray indentation and two drink holders formed therein, a height adjustable tray, and a base support; the two vertical support legs and the rear stand and tray support supporting the stand top and the base support; the height adjustable tray being detachably connectable to the two vertical support legs and the rear stand and tray support; the phone tray assembly including a phone book tray sized to engage the phone book tray indentation of the stand top, an L-shaped support bracket extending from the side edge of the phone book tray, and angled phone tray connected across the L-shaped support bracket, and a tray connecting channel member secured to an exteriorly facing surface of the L-shaped support bracket; the tray connecting channel member having a receiving channel defined therein between two end openings and a side slot sized to engagingly receiving the tray connecting rail of the rear stand and tray support.

It is noted that the embodiment of the phone stand system described herein in detail for exemplary purposes is of course subject to many different variations in structure, design, application and methodology. Because many varying and different embodiments may be made within the scope of the inventive concepts(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A phone stand system comprising:

a stand assembly; and a phone tray assembly;

said stand assembly including two vertical support legs, a rear stand and tray support including a tray connecting rail extending from an upper side end thereof, a stand top with a phone book tray indentation and two drink holders formed therein, a height adjustable tray, and a base support;

said two vertical support legs and said rear stand and tray support supporting said stand top and said base support;

said phone tray assembly including a phone book tray sized to engage said phone book tray indentation of said stand top, an L-shaped support bracket extending from a side edge of said phone book tray, an angled phone tray connected across said L-shaped support bracket, and a tray connecting channel member secured to said L-shaped support bracket;

said tray connecting channel member having a receiving channel defined therein that is sized to engagingly receiving said tray connecting rail of said rear stand and tray support.

2. The phone stand system of claim 1, wherein:

said tray connecting channel member is secured to an exteriorly facing surface of said L-shaped support bracket.

3. The phone stand system of claim 2, wherein:

said height adjustable tray is detachably connectable to said two vertical support legs and said rear stand and tray support.

4. The phone stand system of claim 3 wherein:

said receiving channel of said tray connecting channel member is defined between two end openings and a side slot.

5. The phone system of claim 4 further comprising:

a wall mount assembly that includes a closed bottomed attachment rail sized to engage said tray connecting channel member of said phone tray assembly.

6. The phone stand system of claim 3 further comprising:

a wall mount assembly that includes a closed bottomed attachment rail sized to engage said tray connecting channel member of said phone tray assembly.

7. The phone stand system of claim 2 wherein:

said receiving channel of said tray connecting channel member is defined between two end openings and a side slot.

8. The phone stand system of claim 7 further comprising:

a wall mount assembly that includes a closed bottomed attachment rail sized to engage said tray connecting channel member of said phone tray assembly.

9. The phone stand system of claim 2 further comprising:

a wall mount assembly that includes a closed bottomed attachment rail sized to engage said tray connecting channel member of said phone tray assembly.

10. The phone stand system of claim 1, wherein:

said height adjustable tray is detachably connectable to said two vertical support legs and said rear stand and tray support.

11. The phone stand system of claim 10 wherein:

said receiving channel of said tray connecting channel member is defined between two end openings and a side slot.

12. The phone stand system of claim 11 further comprising:

a wall mount assembly that includes a closed bottomed attachment rail sized to engage said tray connecting channel member of said phone tray assembly.

13. The phone stand system of claim 10 further comprising:

a wall mount assembly that includes a closed bottomed attachment rail sized to engage said tray connecting channel member of said phone tray assembly.

14. The phone stand system of claim 1 wherein:

said receiving channel of said tray connecting channel member is defined between two end openings and a side slot.

15. The phone stand system of claim 14 further comprising:

a wall mount assembly that includes a closed bottomed attachment rail sized to engage said tray connecting channel member of said phone tray assembly.

16. The phone stand system of claim 1 further comprising:

a wall mount assembly that includes a closed bottomed attachment rail sized to engage said tray connecting channel member of said phone tray assembly.

17. The phone stand system of claim 1 further comprising:

a rail mount assembly that includes a closed bottomed attachment rail sized to engage said tray connecting channel member of said phone tray assembly and a horizontal surface mount plate having a plurality of mounting apertures formed therethrough, the horizontal surface mount plate being oriented at a right angle with respect to the closed bottomed attachment rail.

* * * * *